US008708304B2

(12) United States Patent
Dysinger et al.

(10) Patent No.: US 8,708,304 B2
(45) Date of Patent: Apr. 29, 2014

(54) APPLIANCE BASE FOR AN APPLIANCE

(75) Inventors: David Dysinger, Rosenheim (DE); Donald Hendricks, Caryville, TN (US); Timothy Kolody, Powell, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 1392 days.

(21) Appl. No.: 11/998,088

(22) Filed: Nov. 27, 2007

(65) Prior Publication Data

US 2009/0134301 A1 May 28, 2009

(51) Int. Cl.

| | |
|---|---|
| ***F16M 1/00*** | (2006.01) |
| ***F16M 3/00*** | (2006.01) |
| ***F16M 5/00*** | (2006.01) |
| ***F16M 7/00*** | (2006.01) |
| ***F16M 9/00*** | (2006.01) |
| ***F16M 11/00*** | (2006.01) |

(52) U.S. Cl.
USPC ... 248/678; 248/688; 248/346.03; 108/51.11; 108/53.1; 108/53.3; 108/91; 312/228

(58) Field of Classification Search
USPC ..... 248/688, 678, 346.03, 346.5; 108/51.11, 53.1, 53.3, 91; 312/228
See application file for complete search history.

(56) References Cited

U.S. PATENT DOCUMENTS

| | | | | |
|---|---|---|---|---|
| 1,221,939 | A * | 4/1917 | Wirth | 401/88 |
| 2,204,212 | A * | 6/1940 | Gough | 248/688 |
| 2,359,491 | A * | 10/1944 | Ring | 248/152 |
| 2,652,219 | A * | 9/1953 | Arthur | 108/57.14 |
| 3,424,110 | A * | 1/1969 | Toot | 108/53.3 |
| 3,493,201 | A * | 2/1970 | Marran | 248/678 |
| 3,526,195 | A * | 9/1970 | Maryonovich | 108/53.1 |
| 3,934,805 | A * | 1/1976 | Elaschuk | 248/346.4 |
| 4,243,197 | A * | 1/1981 | Wright | 248/678 |
| 4,462,225 | A * | 7/1984 | Noe | 68/3 R |
| 4,562,718 | A * | 1/1986 | Dunk | 72/349 |
| 4,936,117 | A * | 6/1990 | Kabeya | 68/3 R |
| 5,878,984 | A * | 3/1999 | Grieser et al. | 248/188.8 |
| 6,155,527 | A * | 12/2000 | Muyskens | 248/346.03 |
| 6,234,088 | B1 * | 5/2001 | Bredal et al. | 108/91 |
| 6,467,224 | B1 * | 10/2002 | Bertolini | 52/177 |
| 6,520,124 | B2 * | 2/2003 | Bohm, II | 123/2 |
| 6,622,642 | B2 * | 9/2003 | Ohanesian | 108/57.25 |
| 7,028,964 | B2 * | 4/2006 | Baechle | 248/346.01 |
| 7,144,201 | B2 * | 12/2006 | DeArmond, Jr. | 405/286 |
| 7,156,113 | B2 * | 1/2007 | Jerg et al. | 134/93 |
| 7,258,319 | B2 * | 8/2007 | Johanson et al. | 248/346.02 |
| 2002/0017225 | A1 * | 2/2002 | Koefelda et al. | 108/53.3 |
| 2003/0057342 | A1 * | 3/2003 | Johanson et al. | 248/346.02 |
| 2005/0230595 | A1 * | 10/2005 | Cortese | 248/678 |
| 2008/0224016 | A1 * | 9/2008 | Defu et al. | 248/523 |
| 2008/0308709 | A1 * | 12/2008 | Tartan et al. | 248/678 |

* cited by examiner

*Primary Examiner* — Nkeisha Smith
(74) *Attorney, Agent, or Firm* — James E. Howard; Andre Pallapies

(57) ABSTRACT

An appliance base for an appliance for supporting the appliance during manufacture and use, with the appliance base including a skeletal outer frame structure including a generally elongate "U"-base rail member and first and second "U"-side rails extending outwardly from the first and second ends of the "U"-base rail at generally right angles therewith. The outer frame structure defines four corners and a support area intermediate the "U"-base rail member and the "U"-side rails. The appliance base includes an inner frame structure including an index ring disposed in substantially the center of the support area, a plurality of diagonally extending support members with a diagonal support member extending inwardly from each corner of the outer frame structure and fixed to the index ring, and a front rail member extending between diagonal cross members on a side opposite from the "U"-base rail member.

15 Claims, 7 Drawing Sheets

APPLIANCE BASE FOR AN APPLIANCE

BACKGROUND OF THE INVENTION

The present invention generally relates to appliances such as appliances for cooking, washing, and drying and, more particularly, relates to appliance support bases.

Appliances, particularly domestic appliances, are constructed to stand on, or be supported on, an appliance base that typically includes support feet. The support feet are adjustable to level the appliance and support the appliance on a support surface, such as a floor. In general, the appliance base serves as a stable foundation for the appliance and provides structural integrity for the appliance.

Referring to FIG. 1, a known (prior art) appliance base is shown generally at P and includes a sheet metal pan having various openings formed therein for strategic location of fasteners for securing an appliance body (not shown) to the sheet metal pan. The sheet metal pan of the appliance base P is a shallow structure having rolled edges E formed on upstanding wall members that rise from a planer base. A plurality of feet F are attached to the appliance base P and are adjustable to support the appliance base P and the associated appliance disposed on the appliance base in a level arrangement on a support surface such as a floor.

Such pan-type bases are generally adequate for use with appliances, particularly domestic appliances, but there remains room for improvement. The typical pan base is manufactured as a separate component for later assembly with other components of an appliance such as, for example, for later assembly with the sidewalls of an appliance. The typical pan base is difficult to store during the period in which it has not yet been assembled with the other components of an appliance, largely for the reason that pan base does "nest" well with other pan bases—i.e., the pan base typically cannot be compactly and stably arranged in a stacked one on top of another arrangement with other pan bases. Also, the typical pan base can be unnecessarily heavy. Furthermore, it can sometimes be necessary to deploy other parts, not shown in FIG. 1, to assist a pan base in fulfilling its role to stably support an associated appliance on a support surface.

It would therefore be advantageous to provide an appliance base in a configuration that enhances manufacturing ease. Furthermore, it would be advantageous to provide an appliance base having a reduced weight relative to known appliance bases. Additionally, the state of the art of appliance bases would be improved by the availability of an appliance base whose manufacture is facilitated by reason of its configuration. Moreover, the state of the art of appliance bases would be improved by the availability of an appliance base that is relatively easy to store including storing during a period in which the appliance base has not yet been assembled with the other components of an appliance and, in particular, in the event that it is desired to intermediately store the appliance base such that it "nest" well with other appliance bases—i.e., stored compactly and stably arranged in a stacked one on top of another arrangement with other appliance bases. Furthermore, the state of the art of appliance bases would be improved by the availability of an appliance base that has dedicated mounting locations formed therein for support of other appliance components.

DESCRIPTION OF THE PREFERRED EMBODIMENTS

Figure 7:
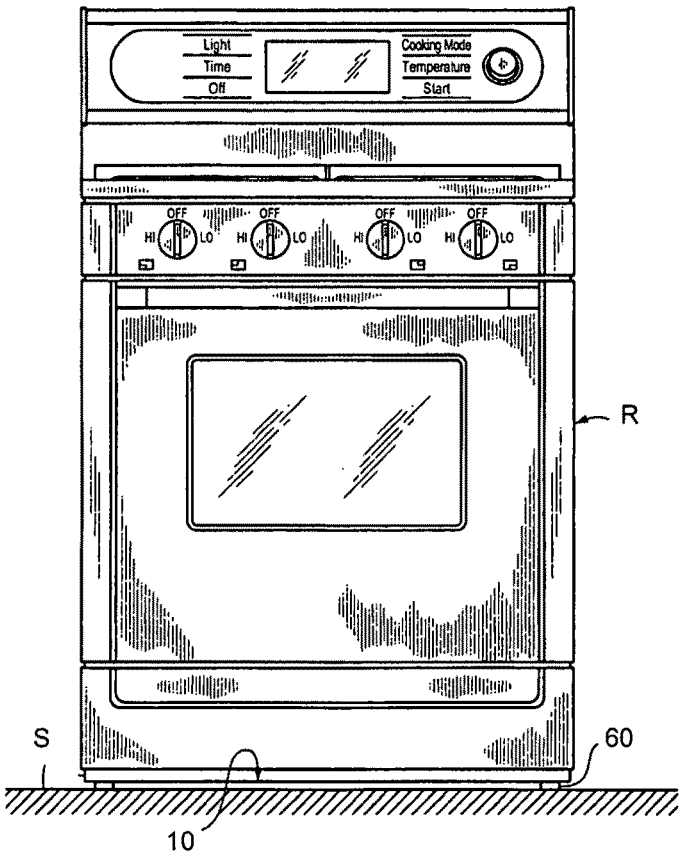
FIG. 7 is an elevational view of a range supported by an appliance base according to the present invention.

Referring now to FIGS. 2-5 and 7, one embodiment of an appliance base 10 for an appliance according to the present invention includes a skeletal frame structure formed from cast metal, structural plastic or composites to provide a structurally sound and rigid foundation on which an appliance can be stably supported on a support surface such as, for example, a floor. For example, the appliance base 10 provides a structurally sound and rigid foundation on which an appliance, in the form of a cooking range R, is stably supported, as shown in FIG. 7.

Figure 1:
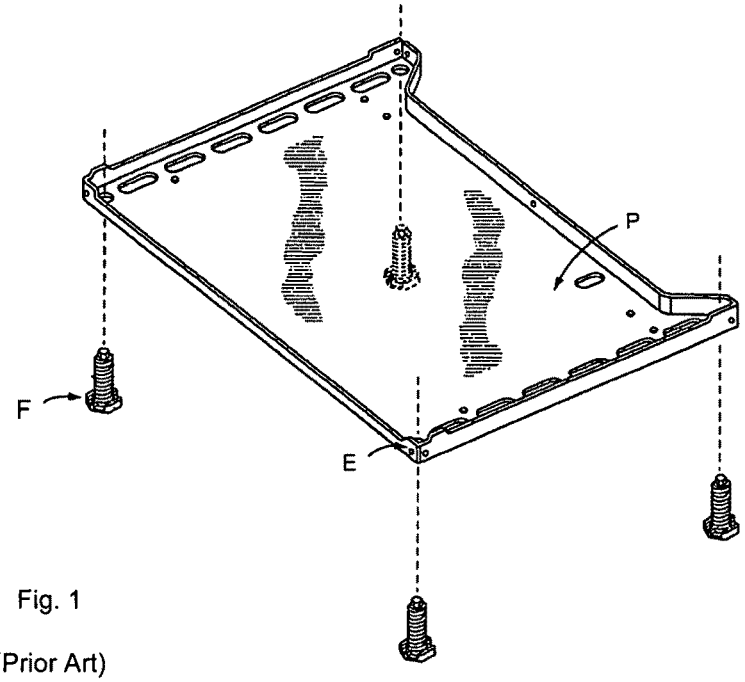
Fig. 1 (Prior Art)
FIG. 1 is a perspective view of a prior appliance base.
Figure 2:
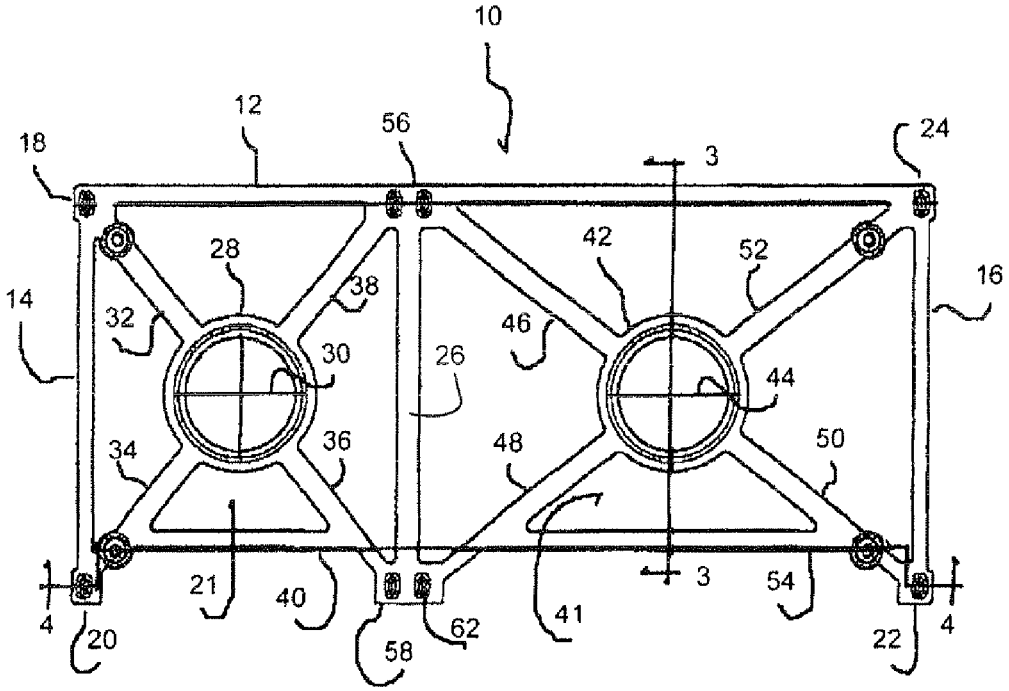
FIG. 2 is a plan view of an appliance base according to one preferred embodiment of the present invention.

With reference now particularly to FIG. 2, the appliance base 10 includes a longitudinally extending "U"-base rail 12 with two longitudinally extending "U"-side rails 14, 16 projecting away from each lateral end of the "U"-base rail perpendicularly thereto, whereupon the longitudinally extending "U"-base rail 12 and the two longitudinally extending "U"-side rails 14, 16 together define a generally open U-shaped frame that delimits an imaginary parallelipiped geometric configuration having two corner portions 18, 24 each formed on a respective lateral end of the "U"-base rail 12 and two corner portions 20, 22 each formed on the respective distal end of one of the two longitudinally extending "U"-side rails 14, 16. A traverse cross member 26 extends outwardly from the "U"-base rail 12 parallel with and between the "U"-side rails 14, 16 and is connected at one end 56 thereof with the "U"-base rail 12 at a location approximately one-third of the longitudinal extent of the "U"-base rail as measured from the one "U"-side rail 14. The length of the traverse cross member 26 is equal to the length of the "U"-side rails 14, 16 as measured from the one end 56 thereof to another end portion 58 thereof. The traverse cross member 26 sub-divides the generally open U-shaped frame formed by the longitudinally extending "U"-base rail 12 and the two longitudinally extending "U"-side rails 14, 16 into two separate open support regions 21, 41—each hereinafter referred to as a ""U"-shaped subframe"—and each of these open regions 21, 41 is also "U" shaped and is open at one end. The two open support regions 21, 41 thus formed by these two "U"-shaped subframes are operable to accommodate further bracing as will be defined presently. The first open support region 21 formed by the one "U"-shaped subframe is approximately half the area of the second open support region 41 formed by the other "U"-shaped subframe.

Each end portion 56, 58 of the traverse cross member 26 and each of the corner portions 18, 20, 22, 24 include receiving elements 62 formed as generally cylindrical openings in the appliance base 10 for use in securing an appliance on the appliance base 10 to be stably supported on a support surface such as, for example, a floor and, in particular, the receiving elements 62 are operable to secure an appliance in the form of a cooking range R as seen in FIG. 7. As will be seen in greater detail hereinafter, a total of four (4) floor-standing feet 60 are fixed to portions of the appliance base 10. As seen in FIG. 7, a cooking range R is disposed on the appliance base 10 which is supported by feet 60 on a support surface S.

Each open support region 21, 41 accommodates a similar diagonal cross member arrangement. Two pairs of diagonal cross members 32, 34, 36, 38 extend inwardly from each corner of the open support region 21 toward a relative common center and two pairs of diagonal cross members 46, 48, 50, 52 extend inwardly from each corner of the open support region 41 toward a relative common center. An index element that is particularly configured to assist in facilitating the stacking of a plurality of appliance bases 10 one on top of the other during, for example, a manufacturing step, is preferably configured as a circular index ring 28 that is located at the interior ends of the diagonal cross members 32, 34, 36, 38 of the open support region 21 at its relative common center with each diagonal cross member attached to the index ring in a symmetrical manner. Another circular index ring 42 is located at the interior ends of the diagonal cross members 46, 48, 50, 52 of the open support region 41 at its relative common center with each diagonal cross member attached to the index ring in a symmetrical manner.

Figure 3:
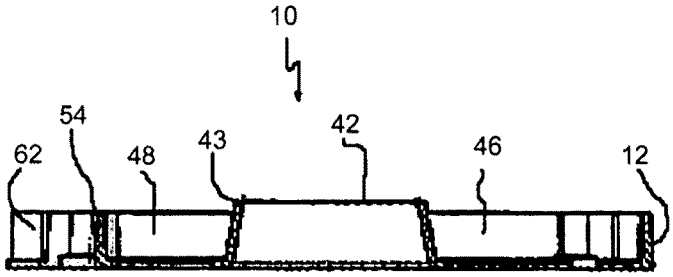
FIG. 3 is a cutaway view of the appliance base illustrated in FIG. 1 taken through lines 3-3 thereof.
Figure 4:
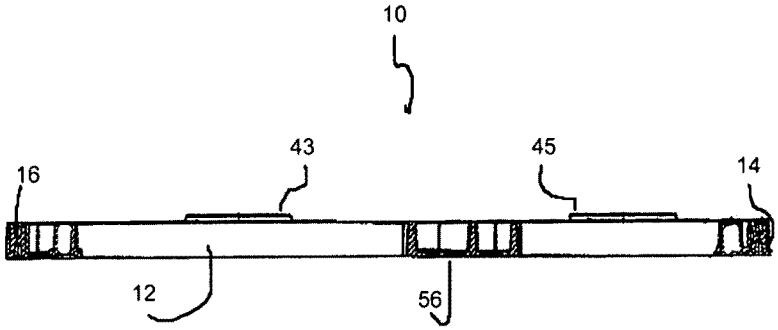
FIG. 4 is a cutaway view of the appliance base illustrated in FIG. 2 taken through lines 4-4 thereof.
Figure 5:
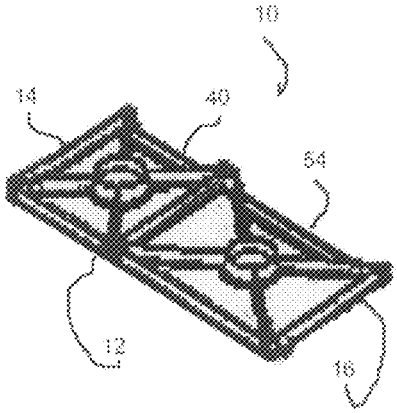
FIG. 5 is a perspective view of the appliance base illustrated in FIG. 1.

As seen in FIG. 3, which is a sectional view of the appliance base 10 shown in FIG. 2 taken along lines III-III thereof, the index rings 28, 42 are conical for enhanced strength. Further, with reference to FIG. 4, which is a sectional view of the appliance base 10 shown in FIG. 2 taken along lines IV-IV thereof, a top portion 43, 45 of each index ring 28, 42, respectively, has an extent higher than the other portions of the appliance base. 10 such that these top portions 43, 45 projects above a plane defined by the appliance base 10 for facilitating "nesting" storage of a number of appliance bases 10—i.e., each stored compactly and stably arranged in a stacked one on top of another arrangement with other appliance bases 10 having the same dimensions—such as, for example, during cooking range manufacturing. Each of the index rings 28, 42 is formed with a crossbar 30, 44 to facilitate manual handling of the base frame.

With reference again to FIG. 2, a longitudinal cross member 40 extends laterally from one diagonal member 36 to another diagonal member 34 within each of the support area 21 and a longitudinal cross member 40 extends laterally from one diagonal member 50 to another diagonal member 48 within the support area 41. Each of the cross members 40, 54 is disposed on the opposite side of the respective index ring 28, 42 as the "U"-base rail 12 with the cross members 40, 54 thus forming a pair of longitudinal rails that are recessed inwardly from the corner portions 20, 22 of the appliance base 10.

Figure 6:
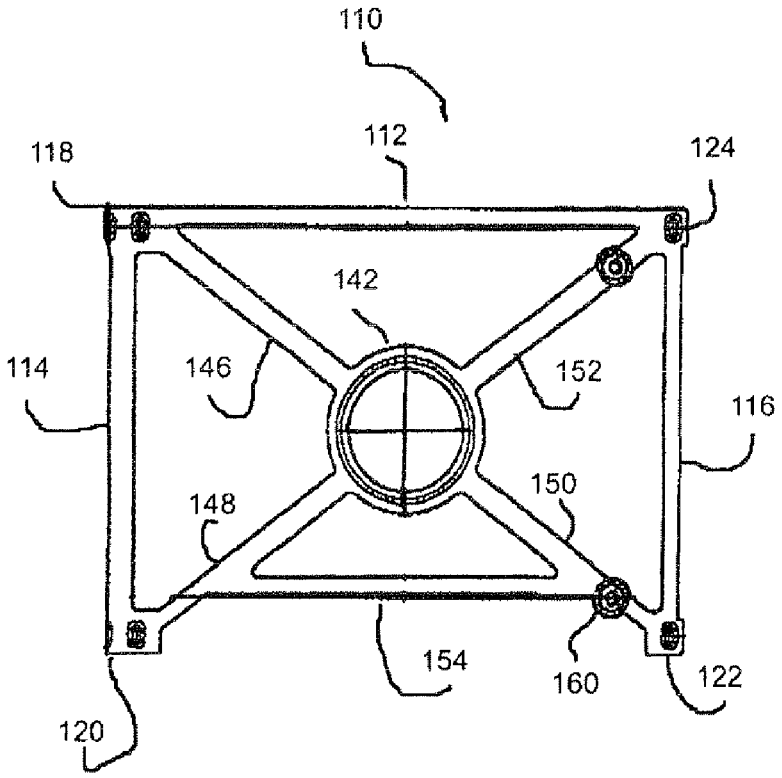
FIG. 6 is a plan view of a second preferred embodiment of the appliance base illustrated in FIG. 2.

As can be seen from the foregoing, the appliance base 10 is divided into the two open support regions 21, 41 with both open support regions 21, 41 being molded or formed as an integral piece. The appliance base 10 is operable to support an appliance such as the cooking range R with both open support regions 21, 41 remaining connected to one another as manufactured and both supporting the single appliance. However, the present invention also contemplates that the appliance base 10 can be deployed to support an appliance having a base area to be supported—i.e., a "footprint"—that is smaller than the combined areas of both open support regions 21, 41 that are available to accommodate an appliance. If, for example, the appliance base 10 is be deployed to provide support for a cooking range that has, say, a base area to be supported—i.e., a "footprint"—having a width dimension of only thirty-inches, and the combined areas of both open support regions 21, 41 that are available to accommodate an appliance have a width dimension of more than thirty inches, the appliance base 10 can be so configured such that one of the open support regions 21, 41 may be disengaged from the other of the open support regions 21, 41 and only a single one of the open support regions 21, 41 is then deployed to support the thirty-inch wide cooking range. On the other hand, this same appliance base 10 can be deployed as well to provide support for a cooking range that has, say, a base area to be supported—i.e., a "footprint"—having a width dimension of forty eight-inches, in which event the cooking range is supported by both open support regions 21, 41 remaining connected to one another as manufactured and both supporting the single appliance in a configuration as seen in the embodiment of the appliance base 10 shown in FIGS. 2-5 and 7. Moreover, the present invention contemplates that the appliance base 10 can be configured and manufactured with only a single one of the open support regions 21, 41 with the thus-manufactured appliance base 10 having a configuration as shown in FIG. 6. As seen in FIG. 6, a single appliance base is illustrated generally at 110 and includes a "U"-base rail 112 and two "U"-side rails 114, 116 interconnected to one another in a manner similar to the embodiment of the appliance base 10 shown in FIGS. 2-5 and 7 having two open support regions 21, 41. Four corners 118, 120, 122, 124 are thusly defined. Diagonal support members 146, 148, 150, 152 project toward a common center from the four corners 118, 120, 122, 124 to intersect with an index ring 142 at approximately the center of the appliance base 110. A longitudinal support member 154 extends from one diagonal member 148 to another diagonal member 150 on a side opposite the "U"-base rail 112. Two support feet 160 are disposed on diagonal members 150, 152, respectively. It should be understood that similar feet can be placed at any convenient location in order to provide four feet for supporting an appliance body. The single frame structure 110 may be stacked for manufacture in the manner of the dual frame structure with the index rings 142 nesting within one another to facilitate stacking and handling.

By the above, the present invention provides an enhanced appliance base for a cooking appliance that provides significant advantages over the earlier, pan-type frames. The present invention provides an appliance base that is formed in a square, repeatable configuration to enhance manufacturing ease and to allow the appliance base to be molded from composites or plastic as well as fabricated from aluminum or other metal. The appliance base provides enhanced structural integrity and enhanced strength against twisting forces and represents a weight loss as compared to earlier appliance bases which can translate into lower shipping costs of completed appliances using the present base frame.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

We claim:

1. An appliance base for an appliance, the appliance base comprising:

a skeletal outer frame structure including:

a "U"-base rail member having a first lateral end portion, a second lateral end portion, and a base rail body extending therebetween, a first continuous "U"-side rail extending outwardly from the first lateral end portion of the "U"-base rail member at a generally right angle therewith, and a second continuous "U"-side rail extending outwardly from the second lateral end portion of the "U"-base rail member at a generally right angle therewith, the outer frame structure delimiting four corners and at least one support area intermediate the "U"-base rail member and the "U"-side rails; and an inner frame structure including:

an index element disposed in substantially a center of the at least one support area;

a plurality of diagonally extending and continuous support members with each diagonal support member extending inwardly from a corner of the outer frame structure and fixed to the index element and a longitudinal cross member extending between diagonal cross members and disposed on an opposite side of the index element from the "U"-base rail member, the appliance base for supporting an appliance during at least one of a manufacturing of the appliance and a use of the appliance, wherein the appliance base includes a first subframe including a first inner frame structure and a first outer frame structure, and a second subframe including a second inner frame structure and a second outer frame structure, with the first subframe and the second subframe interrally formed in a side-by-side relationship.

2. The appliance base for an appliance according to claim 1 and further comprising a plurality of support members disposed on the appliance base for appliance supporting contact with a support surface.

3. The appliance base for an appliance according to claim 1 wherein the first subframe includes about one-third of the appliance base and the second subframe includes about two-thirds of the appliance base.

4. The appliance base for an appliance according to claim 1, wherein a distance from the index element to the longitudinal cross-member in a direction perpendicular to the longitudinal cross-member is smaller than a distance from the index element to the U-base rail member in a direction perpendicular to the U-base rail member.

5. The appliance base for an appliance according to claim 1, wherein the index element comprises an inverted cup-shaped member, and wherein the diagonally extending and continuous support members are fixed to an outer wall of the inverted cup-shaped member.

6. The appliance base for an appliance according to claim 5, wherein when two bases are stacked, a top portion of the inverted cup-shaped member of a bottom base nests inside a hollow bottom of the inverted cup-shaped member of a top base.

7. An appliance base for an appliance, the appliance base comprising:

a skeletal outer frame structure including:

a "U"-base rail member having a first lateral end portion, a second laterl end portion, and a base rail body extending therebetween, a first continuous "U"-side rail extending outwardly from the first lateral end portion of the "U"-base rail member at a generally right angle therewith, and a second continuous "U"-side rail extending outwardly from the second lateral end portion of the "U"-base rail member at a generally right angle therewith, the outer frame structure delimiting four corners and at least one support area intermediate the "U"-base rail member and the "U"-side rails; and an inner frame structure including:

an index element disposed in substantially a center of the at least one support area;

a plurality of diagonally extending and continuous support members with each diagonal support member extending inwardly from a corner of the outer frame structure and fixed to the index element and a longitudinal cross member extending between diagonal cross members and disposed on an opposite side of the index element from the "U"-base rail member, the appliance base for supporting an appliance during at least one of a manufacturing of the appliance and a use of the appliance, wherein the index element is a first index ring tapered inwardly from bottom to top and the first index ring projects beyond a plane defined by the outer frame structure for nesting a top portion of the first index ring with a bottom portion of a second index ring in a second appliance base for nesting the first and second index rings during stacking of the appliance bases.

8. An appliance base for an appliance, the appliance base comprising:

a skeletal outer frame structure including:

a "U"-base rail member having a first lateral end portion, a second lateral end portion, and a base rail body extending therebetween, a first continuous "U"-side rail extending outwardly from the lateral end portion of the "U"-base rail member at a generall right angle therewith, and a second continuous "U"-side rail extending outwardly from the second lateral end portion of the "U"-base rail member at a generally right angle therewith, the outer frame structure delimiting four corners and at least one support area intermediate the "U"-base rail member and the "U"-side rails; and an inner frame structure including:

an index element disposed in substantially a center of the at least one support area;

a plurality of diagonally extending and continuous support members with each diagonal support member extending inwardly from a corner of the outer frame structure and fixed to the index element and a longitudinal cross member extending between diagonal cross members and disposed on an opposite side of the index element from the "U"-base rail member, the appliance base for supporting an appliance during at least one of a manufacturing of the appliance and a use of the appliance, wherein the index element is formed with at least one crossbar to facilitate manual handling of the appliance base.

9. An appliance comprising:

means for handling items; and an appliance base on which the means for handling items is supported, the appliance base having:

(a) a skeletal outer frame structure including:

a "U"-base rail member having a first lateral end portion, a second lateral end portion, and a base rail body extending therebetween, a first continuous "U"-side rail extending outwardly from the first lateral end of the base rail at a generally right angle therewith, and a second continuous "U"-side rail extending outwardly from the second lateral end of the base rail at a generally right angle therewith, the outer frame structure delimiting four corners and at least one support area intermediate the "U"-base rail member and the "U"-side rails; and (b) an inner frame structure including:

an index element disposed in substantially a center of the at least one support area;

a plurality of diagonally extending and continuous support members, each diagonal support member extending inwardly from a corner of the outer frame structure and fixed to the index element and a longitudinal cross member extending between diagonal cross members and disposed on an opposite side of the index element from the "U"-base rail, the appliance base for supporting an appliance during at least one of a manufacturing of the appliance and a use of the appliance, wherein the appliance base includes a first subframe including a first inner frame structure and a first outer frame structure, and a second subframe including a second inner frame structure and a second outer frame structure, with the subframe and the second subframe intergrally formed in a side-by-side relationship.

10. The appliance according to claim 9 and further comprising a plurality of support members disposed on the appliance base for appliance supporting contact with a support surface.

11. The appliance according to claim 9 wherein the first subframe includes about one-third of the appliance base and the second subframe includes about two-thirds of the appliance base.

12. The appliance according to claim 9 wherein the appliance body is a forty-eight inch wide cooking range supported by the first subframe and the second subframe in an engaged configuration.

13. The appliance according to claim 9 wherein the means for handling items is a cooking range.

14. An appliance comprising:

means for handling items; and an appliance base on which the means for handling items is supported, the appliance base having:

(a) a skeletal outer frame structure including;

a "U"-base rail member having a first lateral end portion, a second lateral end portion, and a base rail body extending therebetween, a first continuous "U"-side rail extending outwardly from the lateral end of the base rail at a generally right angle therebewith, and a second continuous "U"-side rail extending outwardly from the second lateral end of the base rail at a generally right angle therewith, the outer frame structure delimiting four corners and at least one support area intermediate the "U"-base rail member and the "U"-side rails; and (b) an inner frame structure including:

an index element disposed in substantially a center of the at least one support area;

a plurality of diagonally extending and continuous support members, each diagonal support member extending inwardly from a corner of the outer frame structure and fixed to the index element and a longitudinal cross member extending between diagonal cross members and disposed on an opposite side of the index element from the "U"-base rail , the appliance base for supporting an appliance during at least one of a manufacturing of the appliance and a use of the appliance, wherein the index element is a first index ring tapered inwardly from bottom to top and the first index ring projects beyond a plane defined by the outer frame structure for nesting a top portion of the first index ring with a bottom portion of a second index ring in a second appliance base for nesting the first and second index rings during stacking of the appliance bases.

15. An appliance comprising:

means for handling items; and an appliance base on which the means for handling items is supported, the appliance base having:

(a) a skeletal outer frame structure including;

a "U"-base rail member having a first lateral end portion, a second lateral end portion, and a base rail body extending therebetween, a first continuous "U"-side rail extending outwardly from the lateral end of the base rail at a generally right angle therebewith, and a second continuous "U"-side rail extending outwardly from the second lateral end of the base rail at a generally right angle therewith, the outer frame structure delimiting four corners and at least one support area intermediate the "U"-base rail member and the "U"-side rails; and (b) an inner frame structure including:

an index element disposed in substantially a center of the at least one support area;

a plurality of diagonally extending and continuous support members, each diagonal support member extending inwardly from a corner of the outer frame structure and fixed to the index element and a longitudinal cross member extending between diagonal cross members and disposed on an opposite side of the index element from the "U"-base rail member, the appliance base for supporting an appliance during at least one of a manufacturing of the appliance and a use of the appliance, wherein the index element is formed with at least one crossbar to faciltate manual handling of the base frame.

* * * * *